US005297893A

United States Patent [19]

Corcoran et al.

[11] Patent Number: 5,297,893

[45] Date of Patent: Mar. 29, 1994

[54] SYSTEM AND METHOD FOR CONTROLLING EMISSIONS CREATED BY SPRAYING LIQUIDS FROM MOVING VEHICLES

[75] Inventors: John Corcoran, Los Angeles; Joseph W. Hower, Long Beach; William A. Moseley, Redondo Beach, all of Calif.

[73] Assignee: Manhole Adjusting Contractors Inc., Monterey Park, Calif.

[21] Appl. No.: 748

[22] Filed: Jan. 5, 1993

[51] Int. Cl.[5] ..... B01D 45/00; E01C 23/00

[52] U.S. Cl. ..... 404/72; 55/302; 55/320

[58] Field of Search ..... 404/72, 87, 110; 55/320, 315, 429, 500, 302

[56] References Cited

U.S. PATENT DOCUMENTS

| | | | |
|---|---|---|---|
| 4,557,739 | 12/1985 | Fortman et al. | 55/320 |
| 4,786,299 | 11/1988 | DeMarco | 55/302 X |
| 5,108,471 | 4/1992 | Poborsky | 55/302 X |
| 5,161,910 | 11/1992 | O'Konek | 404/90 |
| 5,192,343 | 3/1993 | Henry | 55/320 X |

*Primary Examiner*—William P. Neuder

*Attorney, Agent, or Firm*—Nilsson, Wurst & Green

[57] ABSTRACT

A system and a method for controlling emissions caused by spraying liquids from a moving vehicle onto a pavement surface use a vacuum hood mountable to the vehicle and a fan for creating a partial vacuum within the hood to draw air containing emissions into the hood for collection. A filter or other suitable apparatus is used to extract the emissions before the air is discharged to the atmosphere. The vacuum hood is located above the sprayed surface and is preferably located behind the nozzle. It has a primary opening at its forward end for collection of air adjacent the nozzle and a smaller, auxiliary opening behind the primary opening.

26 Claims, 3 Drawing Sheets

SYSTEM AND METHOD FOR CONTROLLING EMISSIONS CREATED BY SPRAYING LIQUIDS FROM MOVING VEHICLES

BACKGROUND OF THE INVENTION

In recent years, asphalt paving oil mixed with recycled rubber has emerged as a preferred paving material because of its superior physical properties and its potential as a solution to a major environmental problem: the disposal of scrap automobile and truck tires. A popular process for the use of such material is described in U.S. Pat. No. 3,891,585 and U.S. Pat. No. 4,069,182, both issued to Charles H. McDonald, the specifications of which are hereby incorporated by reference. According to a current form of this process, recycled crumb rubber obtained from scrap automobile tires is mixed with paving grade liquid asphalt (usually AR 4000) at a temperature of approximately 400 degrees F (199 degrees C.) to form a jellied composition of "asphalt-rubber" which is sprayed at 385–400 degrees F. (189–199 degrees C.) in quantities of approximately 0.55–0.65 gallons per square yard (2.5–2.9 liters per square meter) of pavement or used as a binder in hot mix asphalt (HMA).

A thick cloud of visible emissions is released into the air when hot asphalt-rubber is sprayed onto a pavement surface. These emissions result from the hot liquid coming into contact with the surrounding air and then contacting the pavement itself, both of which are much cooler than the liquid. The emissions produced in applying asphalt-rubber are much greater than those produced by spraying most other materials because non-rubberized materials are typically applied in smaller quantities and/or at lower temperatures. In contrast to asphalt-rubber, a tack coat of conventional paving grade oil is applied in quantities of only approximately 0.05–0.10 gallons per square yard (0.2–0.4 liters per square meter), and conventional prime coat oil is applied at temperatures of only approximately 150–180 degrees F. (63–82 degrees C.).

Although emissions from the spraying of asphalt-rubber compositions have not been shown to be harmful medically, they do present an "opacity" problem at the point of application due to more stringent air quality regulations adopted in recent years. This was investigated by Roberts Environmental Services of West Covina, California and is discussed in a document entitled "The Asphalt-Rubber Producers Group Ambient Air Sampling program" (June 1989), Which reports opacity readings of up to 90% at locations downwind of mobile asphalt-rubber operations.

Prior efforts to reduce emissions in the asphalt industry have focussed on devices for collecting emissions from substantially stationary sources, such as delivery trucks as they are being filled with hot mix asphalt (HMA), or on complex machines which mill, rejuvenate and reapply asphalt pavement in a slow, relatively enclosed process known as asphalt heater scarification/recycling. These systems have not been proposed for mobile spraying operations, however, and are not suitable for liquid asphalt-rubber applications.

Therefore, it is desirable in many instances to reduce or eliminate emissions from a mobile asphalt-rubber application process.

SUMMARY OF THE INVENTION

A large proportion of the emissions produced by spraying heated liquids onto a pavement surface are collected efficiently and inexpensively by the system and method of the present invention without disrupting the continuity of the spraying process or affecting the quality of the treated surface. This is accomplished with a vacuum hood mounted to a distributor vehicle behind a row of nozzles through which the liquid is sprayed. A fan draws emissions-containing air away from the area of the nozzles and passes it through a filter or other suitable apparatus where the emissions are removed. The efficiency of the collection process is enhanced in a preferred embodiment of the invention by placing the hood directly behind the spray nozzles at a location above and out of contact with the pavement surface, and providing the hood with a large primary opening adjacent its forward end. A secondary opening, which may be a slot, is then provided a suitable distance behind the primary opening to collect secondary emissions produced as the liquid cools. In a further embodiment, a flap is provided behind these openings to maximize the collection of visible emissions directly behind the nozzles.

The structure of the filter is specifically adapted to extract emissions of the type created by hot-spray applied materials, such as asphalt-rubber, in a high volume system. It preferably has an extremely fine stage preceded by at least one coarser stage. The coarser stage extracts relatively large particulate matter from the air stream and prevents it from clogging the final stage.

Accordingly, a system and a method for controlling emissions created by spraying liquid from at least one nozzle of a moving vehicle onto a pavement surface involve: a vacuum hood mountable to the vehicle at a location adjacent the nozzle and having at least one inlet and at least one outlet; a fan communicating with the outlet to create a partial vacuum within the vacuum hood and draw air containing emissions through the inlet; and apparatus for receiving the air and extracting emissions therefrom. In a preferred embodiment, the vacuum hood is located behind the nozzle and is adjustable in a vertical direction. It may also have a primary opening adjacent its forward end and a transverse auxiliary opening in the form of a slot behind the primary opening. In a further embodiment, the vacuum hood has a flap extending downwardly from its underside at a location behind its inputs and transversely across the width of the vehicle. The vacuum may also have a main portion extending substantially across the vehicle and at least one side portion movable relative to the main portion between a stowed position in which it is disposed alongside the vehicle and an operating position in which it extends outwardly from the vehicle in line with the main portion.

BRIEF DESCRIPTION OF THE DRAWINGS

The above and other features of the present invention may be more fully understood from the following detailed description, taken together with the accompanying drawings, wherein similar reference characters refer to similar elements, throughout and in which.

DESCRIPTION OF THE PREFERRED EMBODIMENTS

Figures 1, 2, 3:
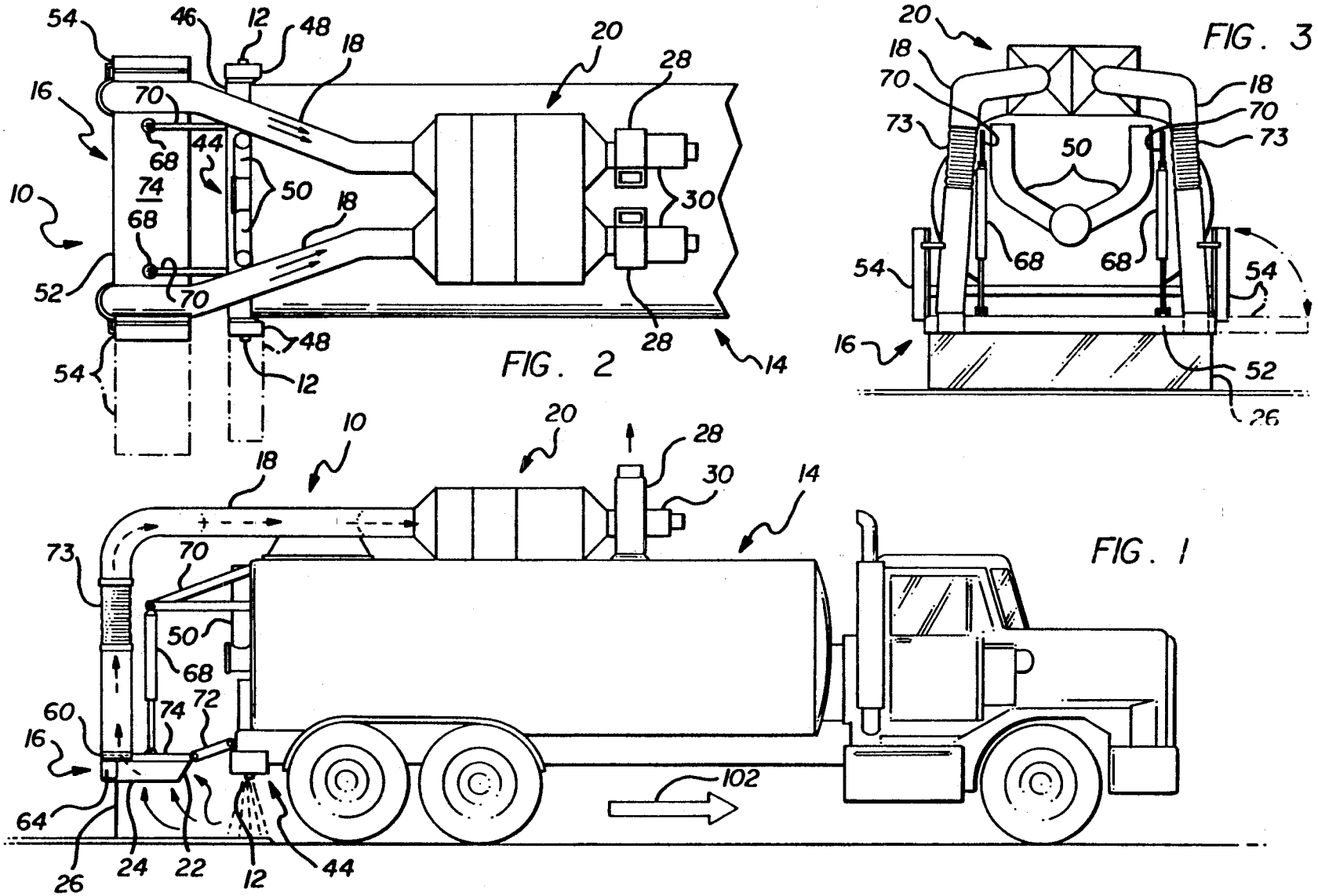
FIG. 1 is a side elevational view of a truck for spraying asphalt-rubber material, the truck being outfitted with a system constructed according to a preferred embodiment of the present invention for controlling emissions created by the spraying process.
FIG. 2 is a top plan view of the truck and system of FIG. 1, shown with the side extensions of the vacuum hood in their stowed positions.
FIG. 3 is a rear elevational view of the truck and system of FIG. 2.

Referring now to the drawings, FIGS. 1, 2 and 3 illustrate a system 10 for controlling emissions created by spraying heated asphalt-rubber compositions or other suitable liquids from a plurality of nozzles 12 of a distributor truck 14. Although asphalt-rubber placement is described herein as a preferred environment for use of the system 10, the system is also useful in applying other pavement-grade liquids which give off emissions. Examples of such liquids are hot spray applied AR 4000, AR8 or any other pavement grade oil, either alone or in combination with a further constituent, such as crumb rubber or a synthetic polymer.

The emissions control system 10 has a vacuum hood 16 disposed behind the nozzles 12 to collect air containing emissions from the spraying operation and pass the air upwardly through ductwork 18 to a filter package 20. The vacuum hood 16 has a primary opening 22 which serves as an inlet at its forward end to collect the majority of airborne emissions and an auxiliary opening 24 located behind the primary opening for collecting secondary emissions produced as the sprayed liquid cools. A flexible flap 26 is disposed behind the auxiliary opening 24 to maximize the flow of air produced by the system in the area directly behind the nozzles 12.

The air flow of the emissions control system 10 is created by a pair of fans 28 which are positioned downstream of the filter package 20 so that they are not exposed to contaminated air. The fans are driven by hydraulic motors 30 to provide a total system air flow of between 2000 and 5000, and preferably approximately 4000, cubic feet per minute (cfm).

Figures 4, 5, 6, 7:
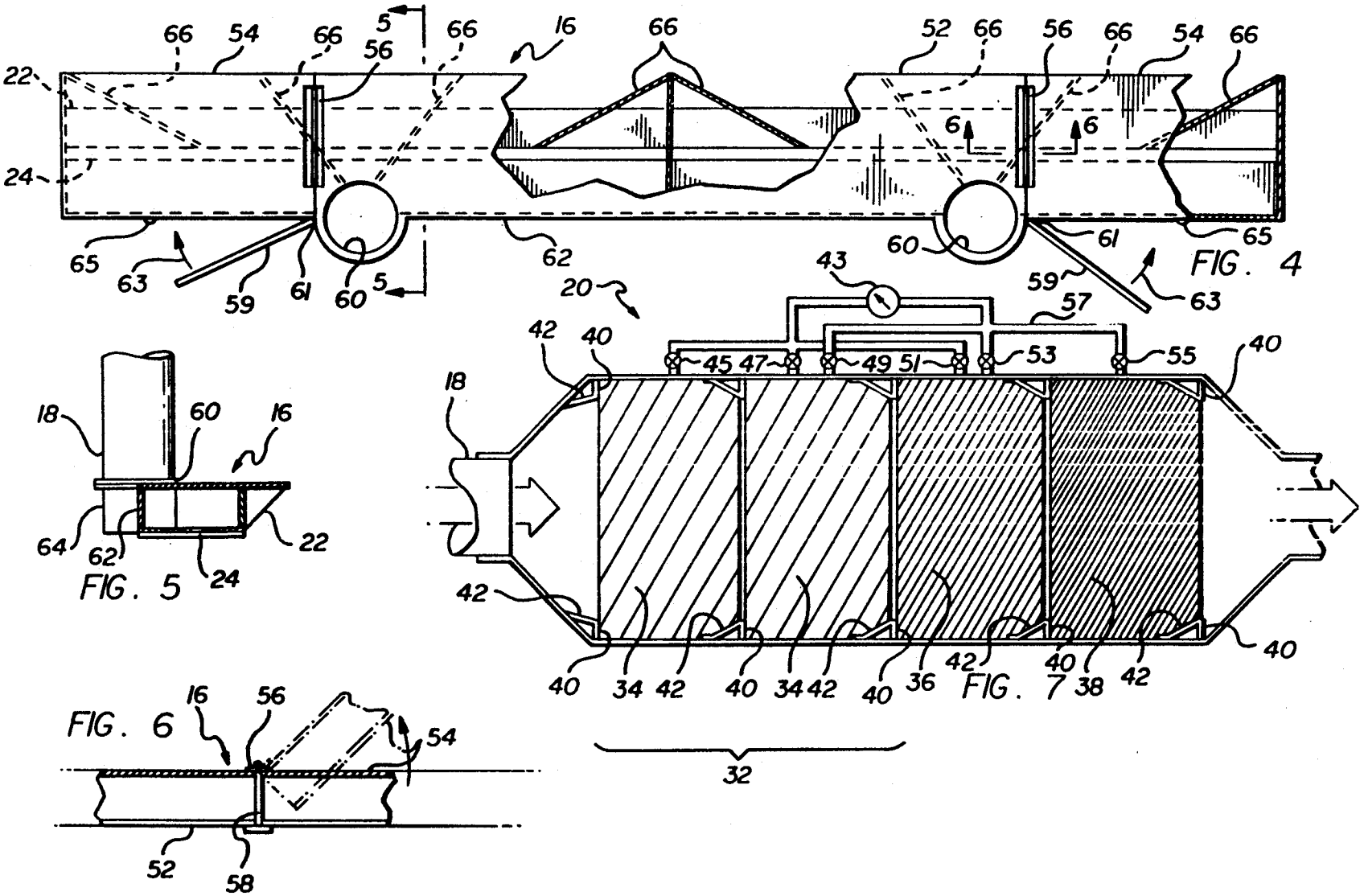
FIG. 4 is an enlarged top plan view of the vacuum hood of the emissions-control system of FIG. 1, shown in isolation with a portion of its upper wall broken away.
FIG. 5 is a vertical sectional view taken along the line 5—5 of FIG. 4 and showing a fragmentary portion of an air duct, attached thereto.
FIG. 6 is an enlarged fragmentary vertical sectional view taken along the line 6—6 of FIG. 4.
FIG. 7 is an enlarged cross-sectional view of a filter structure contained in the emissions control system of the present invention.

The filter package 20, which is seen most clearly in FIG. 7, actually has three different "stages" capable of acting together to extract emissions from the collected air over an extended period without becoming clogged with sticky asphalt-rubber material. The filter package 20 is actually two filter assemblies located side-by-side, each assembly being fed by one of the fans 28. Within each side of the filter package, a first stage 32 is formed of two metal mesh filters 34 placed in series to extract relatively large contaminants (10 microns and above) and prevent them from clogging or "loading" the subsequent filter stages. The metal mesh filters 34 have the advantage that they can be cleaned and reused. A second stage 36 is a disposable paper filter rated 90–95% efficient for particles one micron or larger. A final stage 38, which is optional, is a High Efficiency Particulate Air Filter (HEPA) rated 99.5% efficient in removing particles 0.3 microns and larger.

As shown in FIG. 7, the individual filters of the package 20 are slidable between tracks 40 for ease of removal and installation. A series of inclined baffles 42 are provided directly upstream of these tracks to direct contaminated air away from the tracks and thereby prevent the buildup of bituminous material along the track surfaces.

In the course of operating the system 10, it is important to monitor the pressure across the filter elements so they can be cleaned or replaced before they hamper system performance. Thus, a pressure gauge 43 (FIG. 7) is connectable across any one or more of the filter elements through valves 45–55 of a gauge manifold 57. Taking the final stage 38 as an example, the pressure across it is displayed at the gauge 43 when valves 51 and 55 are open and the other valves are closed. Alternatively, a dedicated gauge can be connected directly across one or more of the filter stages to provide a constant pressure readout.

Referring again to FIGS. 1–3, the truck 14 is a conventional distributor truck of the type used to spray hot bituminous material, such as asphalt-rubber pavement compositions, onto pavement surfaces. The truck 14 has a distributor bar 44 made up of a main portion 46 and a pair of side arms 48 with distributor nozzles 12 on their underside. The side portions 48 are normally in the horizontal position while spreading, but can be moved upwardly to the vertical "stowed" position illustrated in full lines in FIGS. 2 and 3 when it is desired to spray a narrower pattern or when the truck is moved between jobs. As understood by those skilled in the art, the distributor truck 14 contains a heater for the liquid sprayed. The heater is vented through a pair of vent pipes 50.

The vacuum hood 16, like the distributor bar 44, has a main portion 52 extending transversely across the width of the truck and a pair of side portions 54 pivotable between a vertical "stowed" position (shown in full lines in FIGS. 2 and 3) and a horizontal operating condition (shown in phantom lines at the right hand side of FIGS. 2 and 3).

The structure of the vacuum hood 16 is illustrated in more detail in FIGS. 4, 5 and 6, in which the side portions 54 are shown in the horizontal condition. As seen most clearly in FIGS. 4 and 6, the side portions 54 are attached to the main portion 52 by hinges 56 and are sealed to the main portion by gaskets 58 (FIG. 6) to form a single air chamber. In this condition, the vacuum hood 16 is a horizontal flat box elongated in the transverse direction and having the primary opening 22 at its forward edge or face. The primary opening 22 extends the full height and width of the combined vacuum hood, taking the form of an essentially open mouth cut at an angle of substantially fifty degrees from the horizontal to point generally forward and toward the pavement. The auxiliary opening 24 is a relatively narrow slot formed transversely across the width of the vacuum hood 16 approximately ten inches behind the forward edge of the hood.

The vacuum hood 16 also has a pair of side doors 59 (FIG. 4) attached to the rear edge of the main portion 52 by vertical hinges 61 to close the sides of the main portion 52 when the side portions 54 are in their stowed positions. Suitable latches (not shown) are provided to hold the side doors 59 in their closed positions. When it is desired to lower the side portions 54 in order to spray and collect emissions from a wider section of the roadway, the side doors 59 are swung outwardly and rearwardly to the position shown in FIG. 4 before the side portions 54 are lowered. The side doors 59 are subsequently rotated forwardly against the rear wall of the side portions 54, in the direction indicated by the arrows 63, and held against the rear surface of the side portions 54 by latches 65. Thus, the vacuum hood 16 is usable in either its retracted position or its fully extended position, depending on the width of the roadway being sprayed, without loss of vacuum.

Referring to FIG. 5, the ductwork 18 communicates with the interior of the vacuum hood 16 through a pair of outlets 60 of the vacuum hood. The outlets are centered over a back wall 62 of the hood and have cylindrical extensions 64 which form suitable transitions to the interior of the hood 16.

The vacuum hood 16 has a plurality of baffles 66 extending substantially radially from the outlets 60 to provide more uniform air velocity over the width of the hood. The baffles extend into the side portions 54, as well as the main portion 52, to optimize air flow. Due to this configuration and the presence of the flexible flap 26, a strong flow of air into the hood is produced at all points behind the spreader bar 44, causing a large proportion of the emissions from the spraying operation to be collected.

Although the dimensions of the vacuum hood 16 can vary substantially within the broad teachings of the present invention, the following information is offered by way of illustration to explain a specific preferred embodiment of the system 10. According to this embodiment, the main portion 52 is 8 feet (2.5 meters) wide, corresponding to the width of the distributor truck, and the side portions 54 are each approximately 3 feet (0.9 meters) wide. Thus, the total width of the vacuum hood 16 in the fully extended condition is 14 feet (4.3 meters). The front-to-back dimension of the vacuum hood itself is preferably approximately 20 inches (51 centimeters), while the hood is approximately 6 inches (15 centimeters) tall. With respect to the opening sizes, the primary opening 22 is preferably between 3.5 inches (9 centimeters) and 8 inches (20 centimeters) tall, and most preferably, approximately 6 inches (15 centimeters) tall. As described above, the front of the vacuum hood is preferably cut at a 45 degree angle so that the primary opening 22 is directed forwardly and downwardly at a location above and out of contact with the pavement being sprayed. The auxiliary opening 24 is preferably a slot extending the width of the vacuum hood. It can be any width less than or equal to approximately 3 inches (8 centimeters) and is preferably 2 inches (5.2 centimeters) wide. In the embodiment in which the primary opening 22 is 6 inches (15 centimeters) tall and the auxiliary opening 24 is 2 inches (5.2 centimeters) wide, a total system air flow of 4000 cfm results in an air velocity at the primary opening of approximately 425 feet per minute. Under these conditions, ample air flow is provided behind the distributor bar 44 when the vacuum hood 16 is located approximately 8 to 20 inches (31 to 46 centimeters) above the pavement surface.

As shown in FIGS. 1–3, the vacuum hood 16 is supported vertically by a pair of hydraulic cylinders 68 which act against support braces 70 to move the vacuum hood up or down relative to the pavement surface. By adjusting the vertical position of the hood, it is possible to affect the velocity of the air directly behind the spreader bar. The ductwork 18 has a flexible section 73 which permits this movement. The vacuum hood is preferably connected to the distributor truck 14 by links 72 (FIG. 1) which provide fore and aft stability throughout its range of travel.

In addition to the primary purpose of air collection, the vacuum hood 16 is designed to support a "boot man" whose job it is to assure that liquid is sprayed uniformly from the nozzles of the spreader bar 44. For this purpose, a grating 74 is provided atop the vacuum hood 16.

Figure 8:
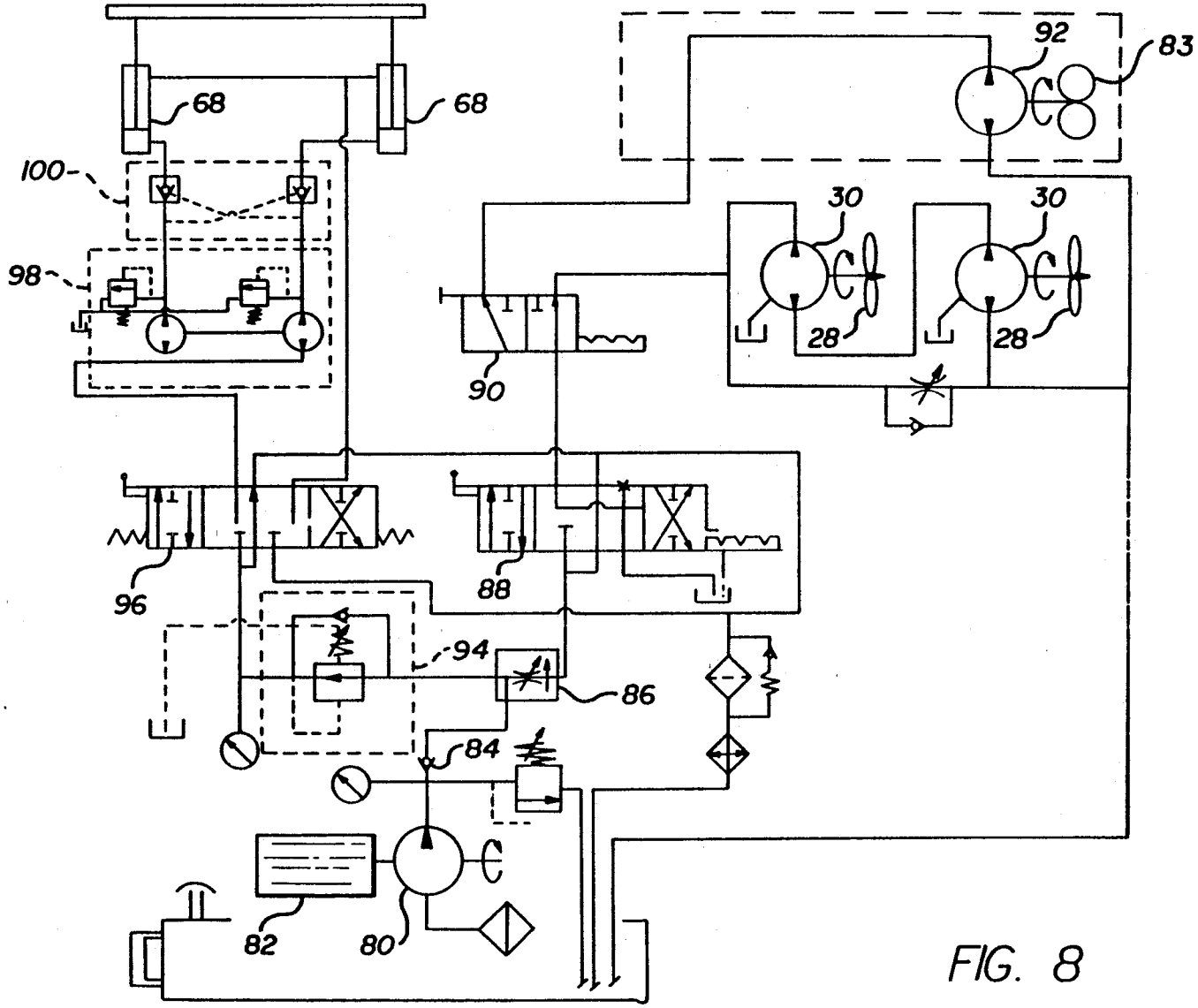
FIG. 8 is a schematic diagram of a hydraulic system of the emissions control system of the present invention.

Referring now to FIG. 8, which illustrates the hydraulic system of the present invention, power to raise and lower the hydraulic cylinders 68 and operate the fan motors 30 derives from a single hydraulic pump 80. The pump 80 is powered by a motor 82 which, in the preferred embodiment, is the prime mover of the distributor truck 14. For these purposes, the hydraulic pump 80 may be a high capacity pump substituted for the pump which normally operates a combustion blower 83 of the distributor truck's engine.

The hydraulic pump 80 provides pressurized fluid to the fan motors 30 through a check valve 84, a priority flow divider 86, a control valve 88 and a selector valve 90. The priority flow divider 86 ensures that the fan motors 30 and/or a combustion blower motor 92 receive priority over the hydraulic cylinders 68. The selector valve 90 is used to select between the combustion blower motor 92 and the fan motors 30.

Pressurized fluid from the pump 80 is also provided to the hydraulic cylinders 68 through a second outlet of the priority flow divider 86, a pressure reducing valve 94 and a directional control valve 96. Equal flow to the two cylinders is assured by a conventional divider/-combiner device 98 which feeds the cylinders 68 through a dual check module 100.

In operation, the operator of the distributor truck first selects the desired height of the vacuum hood 16 and the grating 74 by operating the directional control valve 96 before spraying begins. At this time, the side portions 54 of the vacuum hood 16 are moved downwardly to their horizontal condition, if desired, as are the side portions 48 of the distributor bar 44. The fan motors 30 are then activated through the control valve 88 and spraying is begun. As the distributor truck 14 travels in a forward direction 102, air containing the emissions created by the spraying operation are drawn upwardly into the vacuum hood 16, mostly through the primary opening 22 but also through the auxiliary opening 24 behind the primary opening. The emissions-containing air is then drawn along the ductwork 18, through the filter package 20 and out to the atmosphere as clean air. Most of the sticky bituminous material contained in the air is removed by the metal mesh filters 34 of the filter package 20, after which particles down to one micron in size are extracted by the second stage filter 36 (paper) and particles down to 0.3 microns in size are extracted by the final stage filter 38 (HEPA).

From the above, it can be seen that the system of the present invention dramatically reduces the particulate contamination created when bituminous materials, such as heated asphalt-rubber compositions, are applied by a distributor truck or similar vehicle. Significantly, this function is accomplished without restricting the ability of a "boot man" to ride on the rear of the distributor truck and without impeding his access to the distributor nozzles during use. The spraying operation proceeds just as before, except that the emissions are collected.

The following claims are, of course, not limited to the embodiments described herein, but rather are intended to cover all variations and adaptations falling within the true scope and spirit of the present invention.

What is claimed is:

1. A system for controlling emissions created by spraying a heated liquid paving composition from at least one nozzle of a moving vehicle onto a pavement surface, comprising:

a vacuum hood mountable to the vehicle in a supporting relationship at a location behind said at least one nozzle and above the pavement surface, said vacuum hood having at least one inlet and at least one outlet;

a fan communicating with said at least one outlet to create a partial vacuum within the vacuum hood and draw air containing said emissions through said at least one inlet; and apparatus for receiving said air and extracting said emissions therefrom.

2. The system of claim 1 wherein:

the vacuum hood is located behind the nozzle.

3. The system of claim 1 wherein:

the vacuum hood is adjustable in a vertical direction.

4. The system of claim 1 wherein:

the vacuum hood contains a plurality of baffles extending generally radially from said at least one outlet.

5. The system of claim 1 wherein:

the vacuum hood has a forward end and a rearward end; and said at least one inlet comprises a primary opening adjacent said forward end.

6. The system of claim 5 wherein:

the primary opening comprises a transverse slot at said forward end.

7. The system of claim 5 wherein:

the vacuum hood extends transversely across the vehicle.

8. The system of claim 1 wherein:

said apparatus for receiving air and extracting emissions therefrom comprises a filter structure.

9. The system of claim 8 wherein:

said filter structure is disposed between the vacuum hood and the fan.

10. The system of claim 8 wherein:

said filter structure has a plurality of stages in series, each successive stage extracting particulate matter smaller than the previous stage.

11. The system of claim 10 wherein:

said filter structure has at least one preliminary stage to extract relatively large particulate matter and a final stage for extracting extremely fine particulate emissions.

12. The system of claim 11 wherein:

a final stage of said filter structure comprises a high efficiency particulate air filter.

13. The system of claim 11 wherein:

said at least one preliminary stage comprises a metallic mesh.

14. The system of claim 11 wherein:

said filter structure further comprises an intermediate stage.

15. The system of claim 14 wherein:

said intermediate stage comprises a disposable paper filter.

16. A system for controlling emissions created by spraying liquid from at least one nozzle of a moving vehicle onto a pavement surface, comprising:

a vacuum hood mountable to the vehicle at a location adjacent said at least one nozzle and having at least one inlet, at least one outlet, a forward end, and a rearward end, said at least one inlet comprising a primary opening adjacent said forward end and an auxiliary opening disposed behind the primary opening;

a fan communicating with said at least one outlet to create a partial vacuum within the vacuum hood and draw air containing said emissions through said at least one inlet; and apparatus for receiving said air and extracting said emissions therefrom.

17. The system of claim 16 wherein:

said auxiliary opening comprises a transverse slot and is substantially narrower than the primary opening.

18. A system for controlling emissions created by spraying liquid from at least one nozzle of a moving vehicle onto a pavement surface, comprising:

a vacuum hood mountable to the vehicle at a location adjacent said at least one nozzle and having at least one inlet, at least one outlet, a forward end and a rearward end, said at least one inlet comprising a primary opening adjacent said forward end;

a flap behind said at least one inlet;

a fan communicating with said at least one outlet to create a partial vacuum within the vacuum hood and draw air containing said emissions through said at least one inlet; and apparatus for receiving said air and extracting said emissions therefrom.

19. The system of claim 18 wherein:

said flap is flexible and extends substantially downwardly from the underside of the vacuum hood.

20. A system for controlling emissions created by spraying liquid from at least one nozzle of a moving vehicle onto a pavement surface, comprising:

a vacuum hood mountable to the vehicle at a location adjacent said at least one nozzle, said vacuum hood having a main portion extending substantially across the width of said vehicle and at least one side portion movable relative to the main portion between a stowed position in which it is disposed alongside the vehicle and an operating position in which it extends outwardly from the vehicle in line with said main portion, said vacuum hood further comprising at least one inlet, at least one outlet, a forward end, and a rearward end, said at least one inlet comprising a primary opening adjacent said forward end;

a fan communicating with said at least one outlet to create a partial vacuum within the vacuum hood and draw air containing said emissions through said at least one inlet; and apparatus for receiving said air and extracting said emissions therefrom.

21. The system of claim 20 wherein:

the vacuum hood has two of said side portions mounted for pivotal movement relative to said main portion.

22. The system of claim 21 wherein:

each of said side portions communicates with a respective open side of the main portion; and the main portion includes door structures for closing said open sides when the side portions are in said stowed position.

23. A system for controlling emissions created by spraying liquid from at least one nozzle of a moving vehicle onto a pavement surface, comprising:

a vacuum hood mountable to the vehicle at a location adjacent said at least one nozzle and disposed above and out of contact with said pavement surface when mounted to said vehicle, said vacuum hood having at least one inlet and at least one outlet;

a fan communicating with said at least one outlet to create a partial vacuum within the vacuum hood and draw air containing said emissions through said at least one inlet; and apparatus for receiving said air and extracting said emissions therefrom.

24. A method for controlling emissions created by spraying a heated liquid paving composition from at least one nozzle of a moving vehicle onto a pavement surface, comprising:

supporting a vacuum hood on the vehicle at a location behind said at least one nozzle and above the pavement surface, the vacuum hood having at least one inlet and at least one outlet;

spraying the heated liquid paving composition from said at least one nozzle as said vehicle moves;

creating a partial vacuum within the vacuum hood to draw air containing emissions from the spraying operation through said at least one inlet;

extracting said emissions from said air; and exhausting said air to the atmosphere.

25. The method of claim 24 wherein:

the step of providing a vacuum hood comprises positioning the vacuum hood behind said at least one nozzle for collection of said emissions.

26. The method of claim 24 wherein:

the step of providing a vacuum hood comprises holding the vacuum hood above and out of contact with said pavement surface as said partial vacuum is created.

* * * * *